US005088155A

United States Patent [19]

Grass

[11] Patent Number: 5,088,155

[45] Date of Patent: Feb. 18, 1992

[54] DOOR HINGE WITH RESILIENTLY BIASED RETAINING MEANS

[75] Inventor: Alfred Grass, Höchst, Austria

[73] Assignee: Grass AG, Hochst/Vlbg, Austria

[21] Appl. No.: 579,163

[22] Filed: Sep. 7, 1990

[51] Int. Cl.[5] ..... E05D 7/10

[52] U.S. Cl. ..... 16/257; 16/DIG. 43

[58] Field of Search ..... 16/257, 258, 270, 271, 16/272, DIG. 43

[56] References Cited

U.S. PATENT DOCUMENTS 1,214,263 1/1917 Barber ..... 16/258

*Primary Examiner*—Robert L. Spruill
*Assistant Examiner*—Carmine Cuda

[57] ABSTRACT

Described is a single-articulation hinge with an adjusting arrangement for lateral adjustment and for vertical adjustment, the invention providing a snap-in connection between the door-side section and the frame-side section of the door hinge. Rapid assembly is achieved thereby, because the two-part door hinge is completed through simple sliding together of an intermediate plate mounted on the door side and of a frame-side base plate screwed onto the body of the furniture unit. A snap-in connection is carried out preferably with the help of a spring, which separably connects the two parts.

4 Claims, 3 Drawing Sheets

DOOR HINGE WITH RESILIENTLY BIASED RETAINING MEANS

FIELD AND BACKGROUND OF THE INVENTION

The invention relates to a door hinge with an adjustment arrangement for lateral adjustment and for vertical adjustment of a door wing relative to the body of the furniture unit consisting of a screw-on plate for screwing the door hinge on the body of the furniture unit.

This kind of door hinge is described by U.S. Pat. No. 4,493,129, corresponding to German Patent 31 14 424 in which case the screw-on plate is screwed on the remaining part of the hinge. The disadvantage here is that preliminary mounting of the hinge parts in the door and separate from this on the frame because the hinge is supplied as a finished assembled unit.

SUMMARY OF THE INVENTION

Starting with this situation, the object of the invention is to develop a door hinge of the type described at the outset so as to permit rapid mounting of the hinge in a way that the door-side part of the hinge can be rapidly connected with the body-side part of the hinge without the need for expensive fastening means such as screws.

The invention achieves this object in that the screw-on plate is in two parts, these two parts being separably connected with each other by a locking connection.

After the one part of the screw-on plate, the base plate, is screwed on the body, the hinge can be completed in a simple way in that the second part of the screw-on plate, the intermediate plate, is connected with the base plate by a locking connection. The intermediate plate supports the other components of the door hinge, particularly the articulation with the adjustment arrangement for lateral adjustment and for vertical adjustment as well as the fastening means (fastener barrel) for the door. The locking connection can be actuated without the aid of tools so that both parts can be mounted at any time.

The locking connection will preferably have a spring, which engages and is secured in a suitably shaped receiver of the base plate with a bend of a first leg, its other leg having an inclined leading edge with a locking shoulder, which is positioned on an edge of a recess of the intermediate plate, this recess being provided on a plate section of the intermediate plate, which is positioned in a recess of the base plate on a flange of the base plate.

The spring is thus fixed by its bend in the base plate and is located in the recess of the base plate. All that is needed for mounting is to guide the intermediate plate together with the hinge components fastened to it so that the plate section of the intermediate plate lies on the flange of the base plate, which forms a contact surface. Fastening of the intermediate plate on the base plate is carried out in that the locking shoulder is positioned behind the edge of the opening of the intermediate plate.

All that is needed to release the connection is to operate an actuating piece of the spring so that the locking connection is released again and the intermediate plate can be pulled out of the recess of the base plate again together with the hinge components fastened thereto.

The spring will preferably have an actuating part accessible from the outside, which must be actuated to release the locking connection.

In addition, the spring will preferably have a U-shape, the spring legs forming the legs of the U-shape and its base projecting outward as the actuating part. This will form a particularly secure and highly load-resistant locking connection between the two parts, particularly because the bends of the spring securing the spring on the base plate are doubled and spaced apart. The same applies for the two legs of the spring, which are also doubled and spaced apart. A single actuating part connects the two spring parts and thus actuates the two spring legs, which do the locking.

It should be mentioned that the invention is not limited to the preferred embodiment described above. Any other types and designs of springs can be used for the purpose in mind.

The arrangement can also be reversed so that the spring is fixed on the intermediate plate and carries out a locking connection with the base plate. The important thing is that a locking connection is carried out by spring tension.

The opening of the base plate to receive the intermediate plate is to be directed toward the door side so that the intermediate plate along with its components can be pushed onto the base plate from this side and it will then be in the proper mounting position.

The invention is explained below in more detail using an example embodiment, which will indicate further important features.

DESCRIPTION OF THE PREFERRED EMBODIMENT

Figure 1:
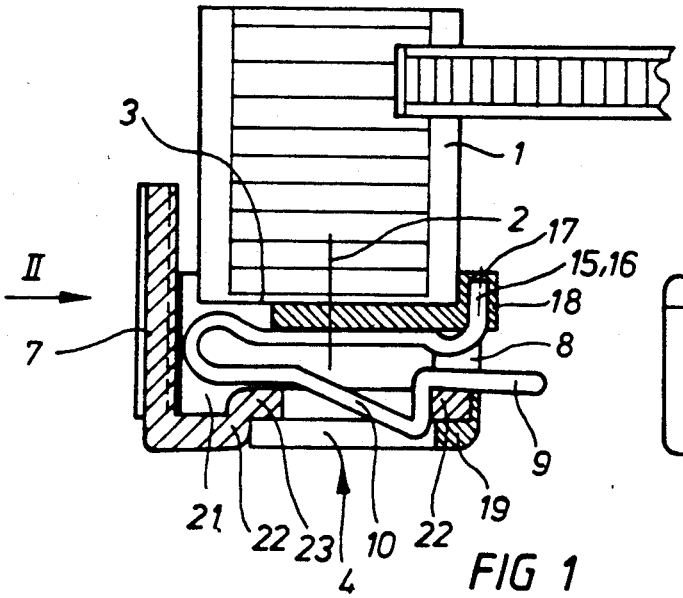
FIG. 1 shows a section through the body-side fastening of such a hinge with a single articulation. Reference is made to U.S. Pat. No. 4,493,129, corresponding to German Patent 31 14 424, for example, with respect to the function of the hinge otherwise, and the disclosures contained therein are included in full in the present invention.
Figure 2:
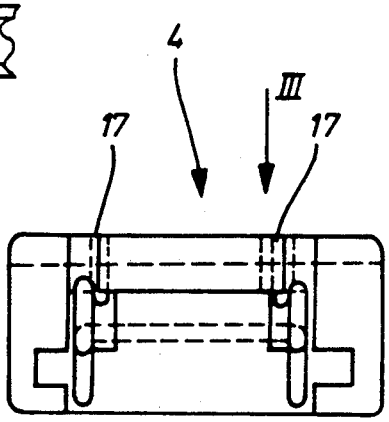
FIG. 2 is a view of the base plate in the direction of the arrow II in FIG. 1.
Figure 3:
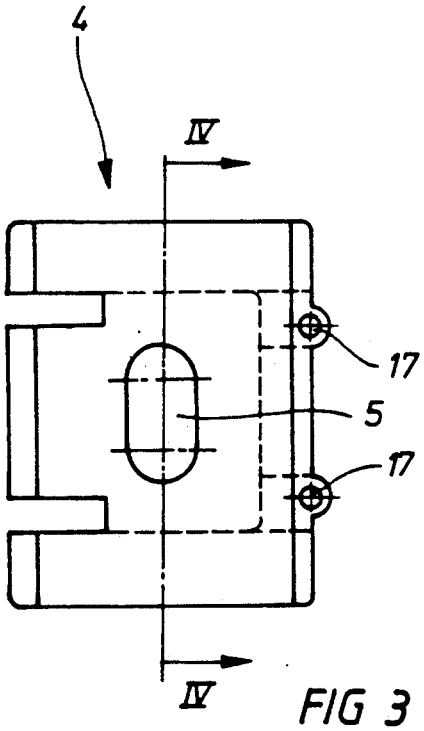
FIG. 3 is a plan view of the base plate in the arrow direction III in FIG. 2.

A base plate or screw-on plate according to FIGS. 1 to 4 consists of a hollow section, the rear end wall having recesses 8 engaged by the spring end 9 of a spring 10. The spring end 9 connects the two spring legs 11, 12 with each other (cf. FIG. 8). Projecting from each spring leg is a further spring leg 13, 14, a bent end 15, 16 being provided on the rear free end of the individual spring leg.

The spring is inserted with this bent end 15, 16 in a borehole 17 in the area of an upwardly directed shoulder 18 of the base plate.

The base plate 4 has a bottom component so that a central recess 21 is formed between a horizontal upper plate and the bottom component into which the intermediate plate 7 with its shoulder 22 can be inserted. As can be seen in FIG. 1, the rear end of the shoulder 22 comes into contact with a raised up wall of the bottom component 19.

Figure 4:
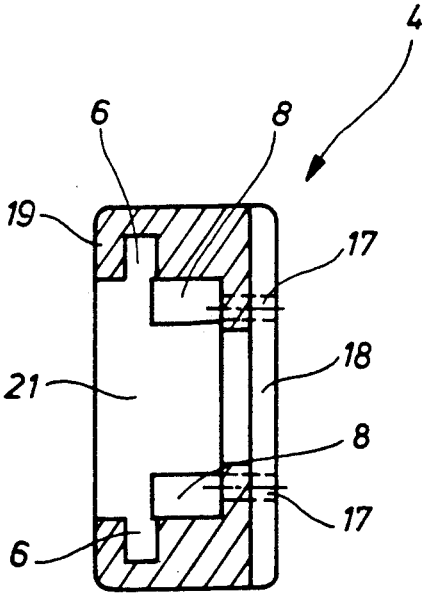
FIG. 4 is a section through the base plate along the line IV—IV in FIG. 3.
Figure 5:
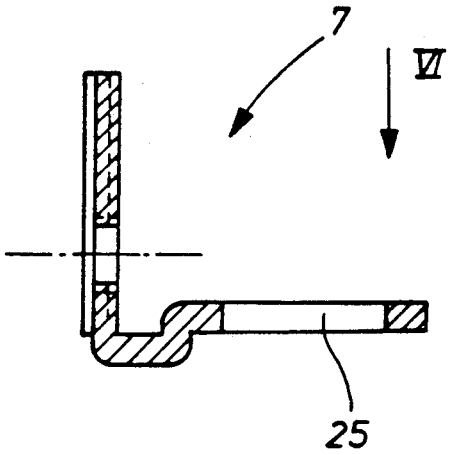
FIG. 5 is a section through the door-side frame/intermediate plate in the direction V—V in FIG. 6.
Figure 6:
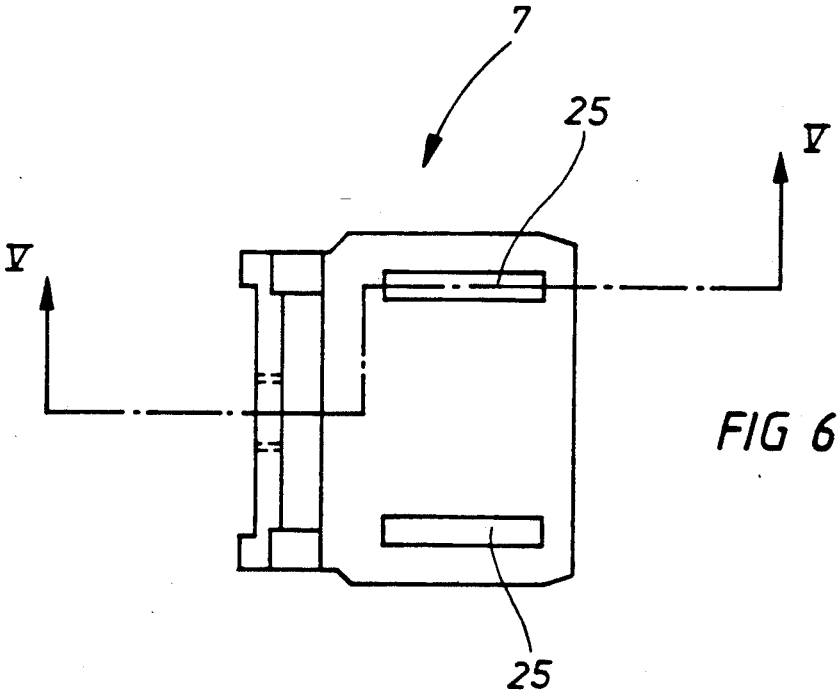
FIG. 6 is a plan view of the intermediate plate in arrow direction VI according to FIG. 5.

Grooves 6 into which the shoulder 22 of the intermediate plate 7 can be inserted are arranged opposite and in alignment with each other (cf. FIG. 4).

The shoulder also has an offset 23, which is in contact with the forward edge of the bottom component 19 and which secures the intermediate plate from displacement.

The base plate 4 is fastened to the end face 3 of the body or frame 1 of the furniture unit with a screw indicated at position 2 in FIG. 1. The screw 2 extends, for example, through a slot 5 (cf. FIG. 3) in the base plate 4 so that the base plate 4 can be displaced vertically with respect to the plane of the drawing of FIG. 1 and fastened on the frame 1.

The spring 10 is then mounted in the base plate 4. The spring 4 consists basically of a combination of a spiral spring and a leg spring.

Figure 7:
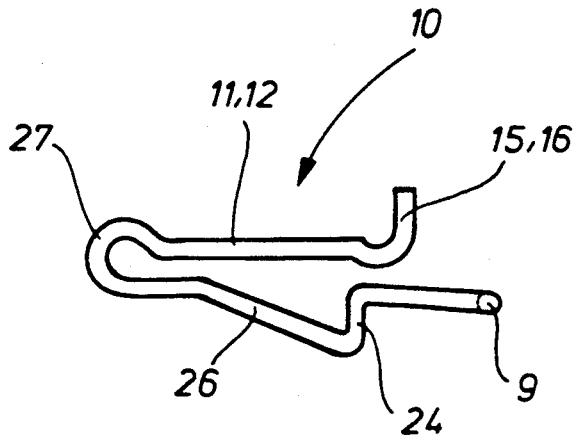
FIG. 7 is a side view of the spring.
Figure 8:
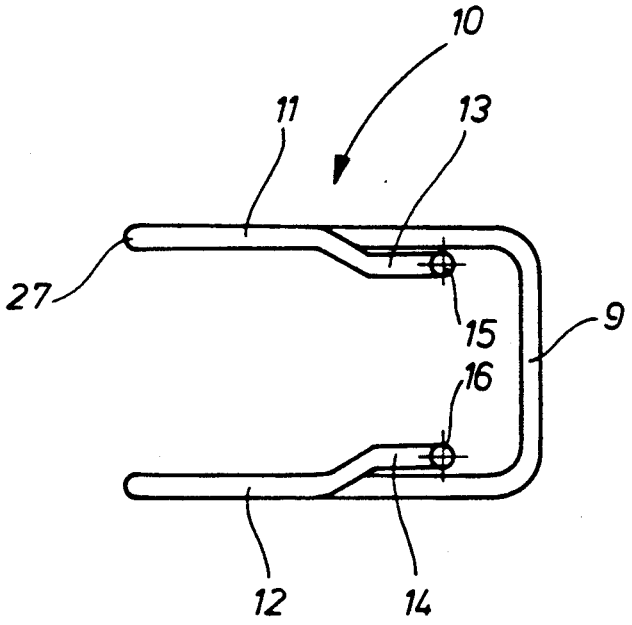
FIG. 8 is a plan view of the spring.

FIGS. 7 and 8 indicate its exact shape.

Extending forward from the spring end 9, which is designed as a clip, is a spring bend 24, which passes through a recess 25 in the intermediate plate in accordance with FIG. 1.

Following the spring bend 24, an inclined leg 26 extends forward, the spring projecting thereby out of the recess 25 of the intermediate plate in accordance with FIG. 1, and this leg 26 then opens into a spring clip 27, which in turn becomes spring legs 11, 12. The spring legs 11, 12 then become spring legs 13, 14, which extend in the same direction, but are bent inward, spring legs 13, 14 then becoming the upwardly bent spring legs 15, 16.

The spring 10 shown is thus mounted in the central recess 21 of the base plate, following which the shoulder 22 of the intermediate plate 7 is inserted into the recess 21, and the intermediate plate 7 is then locked with the spring 10 as described above.

As can be seen, this means a rapid assembly.

The intermediate plate 7 is a part of the door-side part of the hinge. The intermediate plate 7 can be connected with a vertical or lateral positioning device, and the other parts of the hinge arranged on the door side can be fastened through this vertical and lateral positioning device. Reference is made to U.S. Pat. No. 4,493,129, corresponding to German Patent 31 14 424 for further disclosure details.

What is claimed is:

1. A device for releasably mounting an adjustable, single-articulation type door hinge on a supporting frame member comprising:

a base plate mountable on a supporting frame member and having portions defining a spring receiver and a base plate recess;

a spring member having a first spring leg provided with an end portion releasably engageable in the spring receiver and having a second spring leg provided with an inclined portion and a stop shoulder; and an intermediate plate attachable to a door hinge and having portions defining an intermediate plate recess with marginal edges, wherein said intermediate plate is releasably connectable to the base plate with the intermediate plate recess overlapping the base plate recess, the stop shoulder of the second spring leg abutting one of the marginal edges of the intermediate plate recess, and the inclined portion of the second spring leg projecting into said overlapping recesses.

2. The device as claimed in claim 1 wherein said spring member has an actuating portion extending exterior of said base plate.

3. The device as claimed in claim 2 wherein said spring member has a third spring leg, said second and third spring legs each having an end portion extending exterior of said base plate, and wherein said actuating portion of said spring member comprises an actuating part interconnecting said end portions of said second and third spring legs in a generally U-shaped configuration.

4. The device as claimed in claim 3 wherein said spring member has a fourth spring leg, a first spring clip portion interconnecting said third and fourth spring legs, and a second spring clip portion interconnecting said first and second spring legs.

* * * * *